United States Patent [19]

Whitehurst

[11] 4,259,166

[45] Mar. 31, 1981

[54] SHIELD FOR PLATING SUBSTRATE

[75] Inventor: Marshal L. Whitehurst, Indianapolis, Ind.

[73] Assignee: RCA Corporation, New York, N.Y.

[21] Appl. No.: 136,032

[22] Filed: Mar. 31, 1980

[51] Int. Cl.[3] ..... C25D 17/00

[52] U.S. Cl. ..... 204/279; 204/DIG. 7

[58] Field of Search ..... 204/279, 297 W, 5, DIG. 7, 204/15

[56] References Cited

U.S. PATENT DOCUMENTS

| | | | |
|---|---|---|---|
| 2,675,348 | 4/1954 | Greenspan | 204/297 W |
| 2,751,345 | 6/1956 | Osman | 204/297 W |
| 2,890,160 | 6/1959 | Hunting | 204/297 W |
| 3,414,502 | 12/1968 | Porrata | 204/15 |

*Primary Examiner*—T. M. Tufariello

*Attorney, Agent, or Firm*—Birgit E. Morris; Donald S. Cohen

[57] ABSTRACT

In an apparatus for plating the cylindrical flat surface of a metal substrate which is seated in a recess in a substrate case, a shield is mounted on the case around the edge of the surface of the substrate. The shield has an opening therethrough of a diameter adjacent the substrate substantially equal to the diameter of the surface of the substrate, and at the top surface thereof smaller than the diameter of the substrate so as to extend over the substrate. The portion of the opening adjacent the substrate is beveled radially inwardly at an angle of between 45 degrees and 60 degrees.

8 Claims, 2 Drawing Figures

SHIELD FOR PLATING SUBSTRATE

BACKGROUND OF THE INVENTION

The present invention relates to a shield for use in plating a substrate to achieve a layer of substantially uniform thickness across the surface of the substrate. Particularly, the present invention relates to a shield for use in plating a substrate used in making master recordings for high density recorded discs, such as video discs.

Recorded discs generally include a spiral groove in the surface of the disc with the recorded information being within the groove. High density record discs, such as a video disc, have a very high packing density of the grooves, about 10,000 grooves per inch. To achieve such high packing density the groove must be very narrow, about 2.7 microns, and very shallow, about 4,000 Angstroms. Because of these fine dimensions, many of the requirements of materials and processes for the replication of these high packing density discs are different from those used previously to make audio discs.

In the replication system used in the audio record technology, record masters are mechanically cut into a lacquer coated substrate and electroformed to produce nickel molding stampers. It has been found to be unsatisfactory to cut the high packing density, fine dimensioned grooves required for video information in a lacquer coating. However, it has been found that a suitable master can be electromechanically cut in a 0.5 mm thick bright copper layer electroplated upon a smoothly machined 0.5 inch (12.5 mm) thick aluminum disc substrate. However, to achieve a groove of uniform depth and width, the electroplated copper layer should be of uniform thickness across the entire surface of the substrate.

In electroplating a substrate by immersing it in a plating solution, the normal thickness distribution of the plated layer is a thick edge and a thinner center. To overcome this non-uniform distribution, the substrate has been partially immersed in the plating solution, with about 35% of its area exposed above the solution level, and rotated about its center during electroplating. Although this improves the thickness uniformity of the plated layer, it still leaves a non-uniform coating with a thicker outer edge and a hump in the layer near the solution level. Therefore, it would be desirable to be able to electroplate a copper layer on a substrate with the layer being of substantially uniform thickness across the entire surface of the substrate.

SUMMARY OF THE INVENTION

I have found that the use of a particular shield which overhangs the outer edge of the substrate during plating improves the thickness uniformity of the plated layer. The shield includes a body having a bottom surface, a top surface and a circular opening therethrough. The diameter of the opening at the bottom surface is approximately equal to the diameter of the surface of the substrate. The diameter of the opening at the top surface is smaller than the diameter at the bottom surface. The portion of the surface of the opening adjacent the bottom surface is beveled radially inwardly from the bottom surface at an angle of between 45 degrees and 60 degrees.

DETAILED DESCRIPTION OF THE INVENTION

Figure 1:
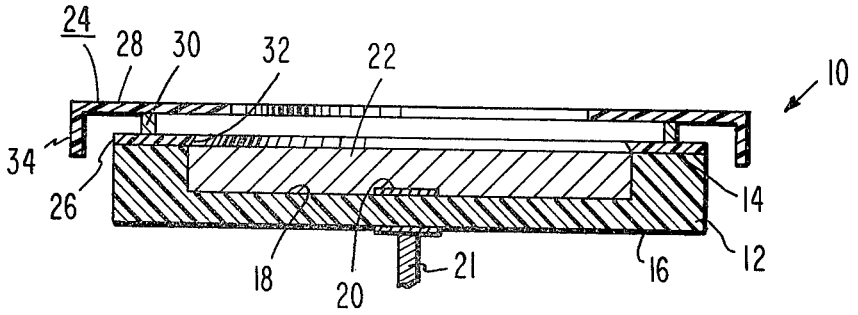
FIG. 1 is a transverse sectional view of an electroplating apparatus which includes one form of the shield of the present invention.

Referring initially to FIG. 1, an apparatus for plating the surface of a substrate is generally designated as 10. The apparatus 10 includes a substrate case 12 of an electrical insulating material, such as a plastic. The case 12 is preferably circular having a flat top surface 14 and a flat bottom surface 16. The case 12 has a recess 18 in the center of its top surface 14. The recess 18 has a circular outer edge of the same diameter as that of the substrate to be plated and a depth substantially equal to the thickness of the substrate to be plated. At the center of the bottom of the recess 18 is a metal electrode 20 which is connected to a bolt 21 extending through the case 12 and projecting beyond the bottom surface 16. The substrate 22 to be plated is seated in the recess 18 and contacts the electrode 20.

A shield generally designated as 24, is mounted on the top surface of the case 12. The shield 24 is a body of an electrical insulating material, such as plastic, having a bottom ring 26, a top ring 28 and spacers 30 between the rings 26 and 28 and connecting them in spaced relationship. The bottom ring 26 is a flat annular plate having an outer diameter corresponding to the outer diameter of the case 12. The inner edge 32 of the bottom ring 26 is of a diameter at the bottom surface of the bottom ring equal to the outer diameter of the substrate 22 and is beveled radially inwardly from the bottom surface of the bottom ring 26 at an angle of between 45 degrees and 60 degrees, and for reasons which will be explained later preferably at 60 degrees. Thus, the inner edge 32 of the bottom ring 26 projects slightly over the top exposed surface of the substrate 22.

The top ring 28 is a flat annular plate having an outer diameter larger than the outer diameter of the case 12 and an inner diameter smaller than the inner diameter of the bottom ring 26. Thus, the top ring 28 extends radially inwardly over the top exposed surface of the substrate 22 and extends radially outwardly beyond the outer edge of the case 12. The top ring 28 has a downwardly extending flange 34 on its outer edge. The inner diameter of the top ring 28 will vary depending on the spacing between the top ring 28 and the bottom ring 26. The inner diameter of the top ring 28 should be such that a line extending from the inner edge of the top ring 28 at the top surface thereof to the inner edge of the bottom ring 26 at the bottom surface thereof is at an angle of about 45 degrees to the bottom surface of the bottom ring 26. The shield 24 may be secured to the top surface 14 of the case 12 by any suitable means, such as screws or bolts.

In the use of the plating apparatus 10, a substrate 22 is placed in the case 12 and the shield 24 is secured to the top surface 14 of the case 12. The plating apparatus 10 is then partially immersed in a suitable plating solution, preferably, at an angle of about 45 degrees, until about 35% of the area of the substrate 22 is exposed above the level of the solution. An electrode of the metal to be plated onto the substrate 22 is also immersed in the solution adjacent the surface of the substrate 22. The case 12 is rotated about its center and a voltage is applied between the substrate 22 and the electrode. The voltage between the substrate 22 and the electrode creates lines of force therebetween which results in the plating of the metal onto the surface of the substrate. Normally, there would be a concentration of the lines of force along the edge of the substrate causing a heavy buildup of the plated metal at the edge of the substrate and forming a hump at the line of the plating solution. However, the shield 24 cuts across the lines of force so as to reduce the buildup of the plating material at the edge of the substrate and thereby provide a more uniform coating on the substrate. I have found that by beveling the inner edge 32 of the bottom ring 26 at an angle of between 45 degrees and 60 degrees, and preferably of about 60 degrees, a coating of very uniform thickness is achieved.

Two flat aluminum substrates, 0.5 inch (12.5 mm) in thickness and 14 inches (37 cm) in diameter, were plated with a layer of copper using the plating apparatus 10. The substrate case having a substrate therein was immersed in an acid copper plating solution of copper sulfate and sulfuric acid, at an angle of 45 degrees with about 35% of the surface area of the substrate exposed above the level of the plating solution. A copper electrode was placed in the plating solution at a distance of 3 inches (7.5 cm) from the substrate. The substrate case was rotated at 50 rpm and a voltage of 6 volts (75 amperes) was applied between the electrode and the substrate. The plating was carried out for four hours. One substrate was coated using a shield 24 in which the inner edge of the bottom ring was beveled at 45 degrees and the other substrate was plated using a shield in which the inner edge of the bottom ring was beveled at 60 degrees. The following table shows the thickness of the copper coating at various places along a radius of the substrate for each of the shields.

| Radius (inches) (from center) | 45° bevel thickness (in) | 60° bevel thickness (in) |
|---|---|---|
| 0.5 | .503 | .500 |
| 1.0 | .498 | .500 |
| 1.5 | .497 | .500 |
| 2.0 | .496 | .500 |
| 2.5 | .496 | .500 |
| 3.0 | .496 | .500 |
| 3.5 | .496 | .500 |
| 4.0 | .497 | .500 |
| 4.5 | .498 | .501 |
| 5.0 | .500 | .500 |
| 5.5 | .501 | .500 |
| 6.0 | .503 | .500 |
| 6.5 | .503 | .501 |

From the preceding table, it can be seen that although the 45 degrees bevel provided a coating of relatively uniform thickness, with a variation of only 0.007 inches across the substrate, the 60 degree bevel provided even a more uniform coating having only a variation of 0.001 inch across the substrate. When a similar substrate was plated without any shield the coating had a variation in thickness of about 0.010 inches with the coating being thicker at the outer edge of the substrate than at the center. Also, stringers of metal of about 0.5 inches in length formed at the outer edge of the substrate.

Figure 2:
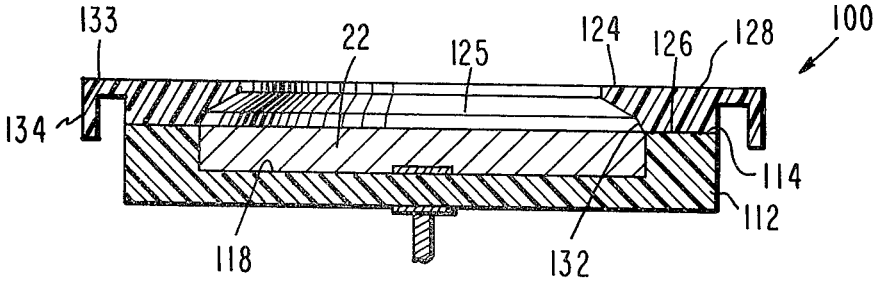
FIG. 2 is a transverse sectional view of a plating apparatus incorporating another form of the shield of the present invention.

Referring to FIG. 2, a plating apparatus having another form of the plating shield, is generally designated as 100. The plating apparatus 100 includes a substrate case 112 identical to the substrate case 12. The substrate case 112 includes a recess 118 in its upper surface 114. The recess 118 is shaped to receive the substrate 22. A shield 124 is mounted on the top surface 114 of the case 112. The shield 124 is a body of insulating material, such as a plastic, having flat bottom and top surfaces 126 and 128 respectively, and a central opening 125 therethrough. At the bottom surface 126 the opening 125 is of a diameter substantially equal to the outer diameter of the substrate 22. A portion 132 of the surface of the opening 125 at the bottom surface 126 is beveled radially inwardly from the bottom surface 126 at an angle of between 45 degrees and 60 degrees. At the top surface 128 the opening 125 is of a diameter smaller than at the bottom surface 126 so that the top portion of the shield 124 extends radially inwardly over the top exposed surface of the substrate 22. The diameter of the opening 125 at the top surface 128 should be such that a line extending from the opening at the top surface 128 to the opening at the bottom surface 126 is at an angle of about 45 degrees to the bottom surface 126. The shield 124 has an annular rim 133 projecting radially outwardly therefrom at the top surface 128, and a flange 134 extends downwardly from the outer edge of the rim 133. The shield 124 may be secured to the top surface 114 of the case 112 by any suitable means, such as screws or bolts. The plating apparatus 100 operates in the same manner as the plating apparatus 10 previously described with the shield 124 serving to provide a coating of uniform thickness across the surface of the substrate 122.

I claim:

1. A shield for use in plating the surface of a substrate having a flat circular surface comprising, a body having a bottom surface, a top surface and a circular opening therethrough, the diameter of the opening at the bottom surface being approximately equal to the diameter of the surface of the substrate, the diameter of the opening at the top surface being smaller than the diameter at the bottom surface, and the inner surface of the opening being beveled radially inwardly from the bottom surface at an angle of between 45 degrees and 60 degrees.

2. A shield in accordance with claim 1 in which the diameter of the opening at the top surface is such that a line extending from the edge of the opening at the top surface to the edge of the opening at the bottom surface is at an angle of approximately 45 degrees to the bottom surface.

3. A shield in accordance with claim 2 in which the surface of the opening at the bottom surface is beveled at an angle of 60 degrees.

4. A shield in accordance with claim 2 in which the body is made of an electrical insulating material.

5. A shield in accordance with claim 4 in which the body is made of a bottom ring, a top ring and spacers between said rings securing the rings together in spaced relation, each of said rings having an opening therethrough with the diameter of the opening in the bottom ring being of a diameter equal to the diameter of the surface of the substrate and having the beveled surface.

6. A shield in accordance with claim 5 in which the surface of the opening in the bottom ring is beveled at an angle of 60 degrees.

7. A shield in accordance with claim 5 in which the top ring extends radially outwardly beyond the bottom ring and has a downwardly extending flange on its outer edge.

8. A shield in accordance with claim 4 including a rim projecting radially outwardly from the body at the top surface thereof and a flange extending downwardly from the rim.

* * * * *